US005794270A

United States Patent [19]

Howat

[11] Patent Number: 5,794,270

[45] Date of Patent: Aug. 18, 1998

[54] PROTECTIVE HEADWEAR

[76] Inventor: Jonathan Macdonald Prentice Howat, 390 London Road, Headington, Oxford, 0X3 8DW, Oxfordshire, England

[21] Appl. No.: 695,447

[22] Filed: Aug. 12, 1996

[51] Int. Cl.[6] ..... A42B 3/00

[52] U.S. Cl. ..... 2/410; 2/468; 2/424

[58] Field of Search ..... 2/410, 411, 412, 2/414, 415, 421, 424, 425, 459, 461, 455, 468

[56] References Cited

U.S. PATENT DOCUMENTS

| | | | |
|---|---|---|---|
| 3,134,106 | 5/1964 | Shaffer et al. | 2/468 |
| 3,153,242 | 10/1964 | Nedwick | 2/411 |
| 3,879,761 | 4/1975 | Bothwell | 2/415 |
| 3,992,421 | 11/1976 | Stratten | 2/455 |
| 4,012,794 | 3/1977 | Nomiyama | 2/411 |
| 4,185,331 | 1/1980 | Nomiyama | 2/411 |
| 4,209,858 | 7/1980 | Coenen | 2/412 |
| 4,825,476 | 5/1989 | Andrews | 2/461 |
| 5,295,271 | 3/1994 | Butterfield et al. | 2/410 |
| 5,353,437 | 10/1994 | Field et al. | 2/468 |
| 5,444,870 | 8/1995 | Pinsen | 2/461 |
| 5,517,699 | 5/1996 | Abraham, II | 2/425 |
| 5,581,816 | 12/1996 | Davis | 2/410 |

*Primary Examiner*—Michael A. Neas
*Attorney, Agent, or Firm*—M. Lukacher

[57] ABSTRACT

Protective headwear, comprising:

a first head covering for covering at least one portion of a person's head;

a second head covering for covering at least one portion of the person's head, at least one portion of said second head covering being within, or adapted to be at least partly within said first head covering, such that the first and second head coverings are in a joint relationship whereby the second head covering is movable relative to the first head covering.

11 Claims, 6 Drawing Sheets

G.6

5794270

PROTECTIVE HEADWEAR

It has been observed for many years that neck and head injuries play a detrimental role in many activities, e.g. motorised sports and their noncompetitive counterparts.

Maiming of bodies, loss of physical function, and loss of life seem to be inherent in many sports enjoyed by spectator and participant. For example, we have seen severe injuries and deaths of participants, primarily due to lack of basic protection. Such problems have been especially acute in motorised sports, e.g. Formula One motor car racing.

When one looks at effects of severe trauma to the head, neck or spine, the underlying complications are those of permanent damage to the brain and spinal cord, i.e. the central nervous system. It is well documented that a whiplash injury creates permanent damage to the posterior ligamentous joints or supports, to the posterior ligament attachments, and to the joints supporting the cervical spine (which preferably contains seven cervical vertebrae) and thoracic spine (which preferably contains twelve thoracic vertebrae). Due to whip of the spine, permanent damage is created to ligamentous attachments, creating an unstable function to the spinal mechanical junctions of the vertebral column. As a result of this damage, both immediately and over an extended period of time, the nervous system is ultimately inhibited in its neurological and physiological responses. This may lead in the long term to such problems as severe headaches, hearing/equilibrium problems, pain to the neck and shoulders, parasthesia to the neck, shoulder, and arm areas, difficulty in breathing, swallowing, talking, masticating, loss of hearing, visual distortions, and parasthesia to the face, arms, and legs.

In examining the effects of whiplash trauma, there are:

(a) damage to the ligamentous system, (b) damage to the muscular system, (c) damage to the skeletal system, (d) damage to the nervous system.

Although long term effects of the symptomotology are not at first attributed to trauma to the muscular skeletal system, trauma to the skeletal structures will in due course create neurological and physiological deficits to the normal function of the body. The effects on neurological response to all sensory and motor functions affects normal physiology.

It has been found in accordance with the present invention that novel protective headwear may be provided to prevent or reduce risk of e.g. head and/or neck injuries in any suitable application of the invention, for instance when the protective headwear is a helmet for participants in any suitable activities or circumstances, e.g. in american-football, boxing, cycle racing, flying, horse riding, motor boat racing, motor car racing, motor cycle racing, parachuting, rugby, skiing, etc. In general, the present invention may be applied to any suitable application in any suitable environment, e.g. in sporting activities or non-sporting activities, for instance civil engineering (e.g. on building or other construction sites or in mining).

According to a first aspect of the present invention, protective headwear (e.g. a helmet for a participant in a suitable activity) comprises:

a first head covering for covering at least one portion of a person's head, and optionally at least one portion of the person's neck, and optionally at least one portion of the cervical spine, said first head covering optionally being at least partly protectively rigid relative to said person, said first head covering optionally being able to allow said person to view directly or indirectly out of said first head covering, said first head covering optionally being releasably fastenable to said person; and a second head covering for covering at least one portion of the person's head, and optionally at least one portion of the person's neck, and optionally at least one portion of the cervical spine, said second head covering optionally being at least partly protectively rigid relative to said person, said second head covering optionally being able to allow said person to view directly or indirectly out of said second head covering, said second head covering optionally being releasably fastenable to said first head covering and/or said person, at least one portion of said second head covering being at least partly within, or adapted to be within, said first head covering so as to be closer to the person's head, said second head covering being movable relative to said first head covering such that said first and second head coverings are in a joint relationship, optionally a ball and socket joint relationship wherein said first head covering constitutes a socket portion and said second head covering constitutes a ball portion of said ball and socket joint relationship; and optionally at least one friction reducing means for reducing friction between said first and second head covering during said motion of said second head covering.

A second aspect of the invention provides said first head covering for the first aspect of the invention.

A third aspect of the invention provides said second head covering for the first aspect of the invention.

A fourth aspect of the invention provides said friction reduction means for the first aspect of the invention.

A fifth aspect of the invention provides at least one kit of parts for providing any one of said first, second, third, and fourth aspects of the invention.

The term "protectively rigid" refers to sufficient rigidity to provide a barrier that is protective against impact. The barrier may be flexible and/or resilient in manner(s) compatible with the sufficient rigidity.

The first head covering may immobilize or substantially immobilize provide any suitable freedom of any predetermined number of cervical vertebrae, preferably seven.

The first head and/or said second head covering respectively optionally comprises at least one cheek covering, optionally comprises at least one jaw covering, optionally comprises at least one neck covering, and optionally comprises at least one shoulder covering, and optionally comprises at least one spinal joint covering.

The first head covering and/or the second head covering respectively may be an integral or composite structure. The first head covering may comprise supportive material(s) and/or supportive member(s), e.g. for supporting at least one portion of the second head covering, and/or for providing support from at least one portion of the cervical spine to at least one portion of the person's shoulder girdle.

The first head covering and/or the second head covering may be made from any suitable material(s), for example the materials may comprise polymeric materials, for instance epoxy resins, nylons, polycarbonates, polyvinylchorides, etc. Such polymeric material(s) may comprise reinforcing material(s), e.g. carbon fibres, glass fibres, etc., for desirable strength/weight ratios of the protective headwear.

The protective headwear may comprise further component(s) other than the first head covering and/or the second head covering, e.g. resilient materials(s) and/or resilient member(s), for instance elastomer(s) for lining(s), shock absorber foams, etc., as mentioned later below.

The protective headwear may be assembled in any suitable manner(s). The headwear may be embodied for any suitable purposes, e.g. as a helmet in sports or other applications. In general, the second covering may be inserted in any suitable manner(s) into the first head covering.

The ball and socket joint relationship of the first and second coverings allows the head to move left to right, right to left, down to up, up to down, and rotationally, e.g. to allow for sufficient freedom of viewing when the first and second head coverings are adapted to allow the person's eye(s) to see through them. The ball and socket joint relationship may resemble the normal anatomical relationship of a hip joint which allows for e.g. rotational motion(s) without distortion to its fundamental stability.

At least one portion of the first head covering and/or at least one portion of the second head covering may be suitably transparent and/or comprise at least one respective viewing aperture or viewing window or viewing window portion. The first head covering and/or the second head covering may comprise a respective vizard or visor—e.g. Pointable in any suitable direction(s)—for viewing out of and via said viewing aperture or said window or said window portion. A visor or vizard may have any suitable optical property(s), e.g. for protecting the eyes against glare and/or sunshine.

From a bio-mechanical view, the first and second head coverings may provide at least substantially symmetrical and at least substantially equal protection to the cranium and the brain. The preferred centre of rotation of the second head covering may take place through the posterior part of the sella tursica, which is the center of the cranium, and therefore optimum protection may be provided of that region.

The first head covering may create stability:

(a) from the middle of the skull to both shoulders when looking from back to front, and (b) from the middle of the skull to both anterior and posterior aspects of the shoulder girdle when looking from a side.

The first head covering may have any suitable construction and shape. The first head covering (e.g. a retainer capsule) may encapsulate not only at least one portion of the second head covering but optionally contain at least one portion of the person's neck and optionally at least one portion of the cervical spine. The shoulder girdle comprises a clavicle, scapula, and humerus. The clavicle adheres to the sternum at the sterno-clavicular junction. The shoulder girdle will provide a firm foundation for the first head covering in the event of trauma. The first head covering may encapsulate the second head covering by more than the general diameter of the second head covering, preferably encapsulate the second head covering by at least a convex arcuate extent substantially 180° to at least substantially 200°, which may be measured from the start of the convexity, e.g. corresponding to commencing at the uppermost cervical vertebra, i.e. at the region of the atlanto-occipital junction between the base of the skull and the neck. The first head covering may retain at least one portion of the second head covering despite said motions of the head.

The first head covering may have a centre point at the posterior margin of the sella tursica, which is the anatomical mid point of the cranium from anterior, posterior, medial, and lateral positions. The first head covering may provide protection of the cranium and cervical spine regardless of where force is applied.

Preferably, the first head covering is integral with at least one said optional neck covering thereof and at least one said optional shoulder covering thereof.

Preferably, the first head covering comprises at least one release means for releasably fastening the first head covering to the person. Preferably, at least one said release means is comprised by at least one said shoulder covering. For example, in order for the person to put on or take off the headwear, at least one said release means may comprise at least one flap (e.g. flexible and/or hinged from the shoulder girdle on one side so as to cross over the anterior part of the body and releasably fasten onto the opposite shoulder, e.g. to an optional quick release fastener (e.g. a button) on that shoulder. A counterpart of that flap may be placed on top of and releasably fastened onto the opposite shoulder (e.g. to a further optional quick release fastener, for instance a button), so as to fasten the headwear to the person and allow for rigid stability of the cervical spine. The at least one quick release fastener(s) allow for the first and second head coverings to be placed into position and removed with expediency, and may be designed to anticipate quick and safe removal of the headwear. Shoulder pads may be provided on tunic(s) or other clothing for the person, and the shoulder pads may have said quick release fasteners on both the posterior and anterior aspects of the shoulders. For example, there may be four quick release fasteners (e.g four buttons) to ensure the first head covering is fastened into position in order to protect e.g. the cervical spine and the skull.

The second head covering (e.g. a head capsule) may have any suitable construction and shape, e.g. be at least substantially spherical. Preferably, the interior of the second head covering is adapted to mould itself to the individual cranium, e.g. may comprise a mouldable elastomeric lining for that purpose. The second head covering is preferably shock absorbing, e.g. its inside and/or exterior may comprise shock absorbent material(s) (e.g. shock absorber foam). Preferably, the second head covering will protect the entire skull, face, and jawbone. The second head covering (i.e. the head capsule) may comprise at least one optional suture provided by means of e.g. at least one optional T-junction suture (e.g. optional T-junction suture 31 in FIG. 5 of the accompanying drawings) that may be comprised by the second head covering, thereby corresponding to at least one of the direct anatomical sutures of the cranium, and in so doing allowing compression through e.g. the T-junction suture(s) to permit the first head covering to be positioned over the second head covering. When this happens, the second head covering (preferably because of said mouldable lining) may expand sufficiently to enable an efficient ball and socket joint relationship between the first and second head coverings. The at least one suture may replicate or substantially replicate physiological function(s) of the cranium.

Said optional friction reduction means may reduce friction at the junction between the first and second head coverings so as to aid freedom of motion of the head through fields of vision. One example of said friction reduction means comprises at least one ball bearing means, optionally comprised by the exterior of the second head covering so as to roll over the interior of the first head covering. Another example of said friction reduction means comprises friction reduction polymeric material(s)—e.g. polytetrafluoroethylene and/or silicone—e.g. a coating (for instance suitable grease and or oil) or member on the interior of the first head covering and/or the exterior of the second head covering, or therebetween. At least one friction reduction means may be present in said ball and socket joint relationship. At least one said friction reduction means may be permanently in place or at least partly replaceable.

The protective headwear of the invention provides protection to the skull as well as to its mechanical counterparts in the cervical, thoracic and lumber spine. Up to now, little priority has been given to the structures which support the head, namely the upper cervical spine. In this respect, when talking about the upper cervical spine, one is talking primarily of the first four cervical vertebra. The first three cervical vertebra by their anatomical description attach to the dural/meningeal system, which is the protective membrane round the brain and spinal cord. The fourth cervical vertebra allows the exit of the phrenic nerve which controls the diaphragm and ultimately breathing. Damage to the upper four cervical vertebra will render the person dead either through damage to the brain stem or to the respiratory mechanism. Damage to the cervical spine and into the thoracic spine from the fourth cervical vertebra will determine whether the person becomes a quadraplegic or a paraplegic. This, in terms of life expectancy, is very critical to the problem of providing protection. In terms of rehabilitation, finance and institutions that have the responsibility of looking after these people, treatment is long, arduous, expensive and very often unfulfilled. The protective headwear of the present invention may protect not only the skull and brain but also the most important and crucial areas of the upper cervical spine.

The protective headwear of the invention may comprise any other component(s). For example, the protective headwear may comprise resilient material(s) and/or resilient member(s), for instance elastomers for linings, shock absorber foams etc. Some examples of the other components are audio means and/or video means, for receiving and/or transmitting audio information and/or video information, e.g. reference information and/or signal information. Some further examples of other functional component(s) are at least one aperature means e.g. conduit means (for instance tubing) or a grill or louvres, etc., e.g. for delivering to and/or receiving from the protective headwear any suitable fluid, e.g. air and/or nutritional liquid(s). Another example of a component may be a gaseous atmosphere having any suitable pressure.

It will be appreciated that the protective headwear may comprise at least one shock absorber property, e.g. to aid support and protection of the cervical spine, preferably optimally. The protective headwear may comprise at least one shock absorber means at least partly between the first head covering and the second head covering. The first head covering and/or the second head covering may comprise at least one shock absorber means. Some examples of shock absorber means are said shock absorber foams prepared from any suitable polymeric materials, e.g. elastomers.

It will be appreciated that said first head covering may be protectively rigid. Said first head covering may be adapted to allow the person to view through said first head covering. At least one portion of said first head covering may be adapted to cover at least one portion of the person's neck. At least one portion of said first head covering may be adapted to cover at least one portion of the person's cervical spine. At least one portion of said first head covering may be adapted to cover at least one portion of the person's shoulders. At least one portion of said first head covering may be adapted to cover a portion of the person's chest. At least one portion of said first head covering may be adapted to cover at least one portion of the person's back.

At least one portion of said first head covering may be articulatable relative to at least one further portion of said first head covering. For example, the skull portion of the first head covering may be articulatable relative to the shoulder portion of the first head covering. At least one articulation means may be provided for this purpose, e.g. between the skull portion and the shoulder portion of the first head covering. The at least one articulation means may replicate at least one portion of the muscular system of the person's neck in various motion(s), e.g. bending, compressing, extending, flexing, rotating, translating (e.g. side-to-side) motions. The at least one articulation means should be rigid, to prevent collapse of the skull portion onto the shoulder portion of the first head covering. The at least one articulation means may be shock absorbing. The at least one articulation means (and the rest of the first head covering) should protect against penetration by impact, e.g. of stones, etc. onto the at least one articulation means. The at least one articulation means may be made from any suitable material (s), e.g.: fabric(s), which may be woven and/or unwoven and may comprise natural and/or synthetic material(s); elastomer(s), e.g. natural and/or synthetic rubber(s), mesh (es), which may be metal and/or non-metal meshes; and/or spring(s), which may be metal and/or non-metal flat coils, and/or wire(s), which may be metal and/or non-metal.

For convenience of description, the at least one articulation means may be regarded as e.g. a protective articulatable neck-covering, e.g. a stock.

It will be appreciated that said second head covering may be protectively rigid. Said second head covering may be adapted to allow the person to view through said second head covering. At least one portion of said second head covering may be adapted to cover at least one portion of the person's neck. At least one portion of said second head covering may be adapted to cover at least one portion of the patient's cervical spine.

In the accompanying schematic drawings which are by way of example of the present invention:

Figure 5:
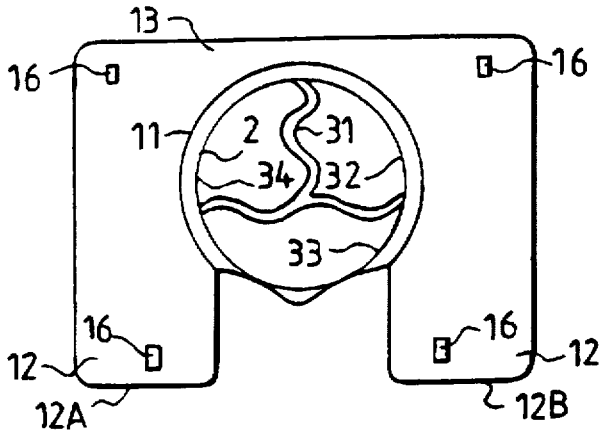
FIG. 5 is a top view corresponding to FIG. 4, and including a T-junction suture.
Figure 6:
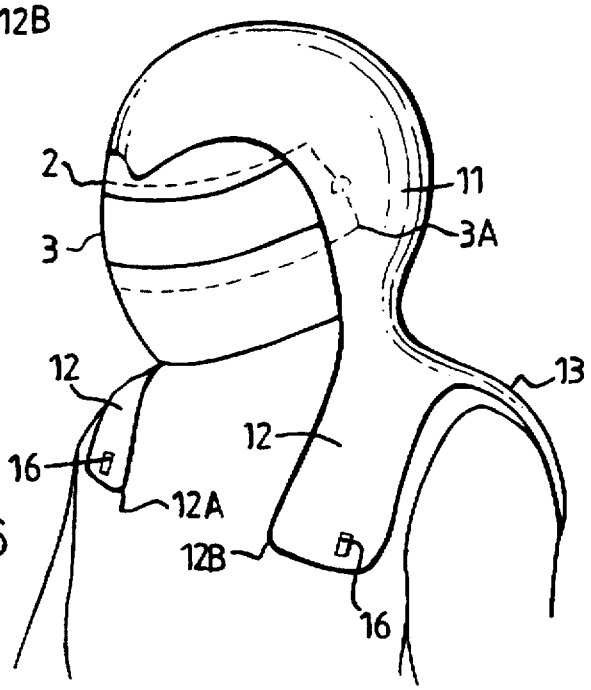

FIG. 6. is a pictorial front view corresponding to FIG. 5.

Figure 2:
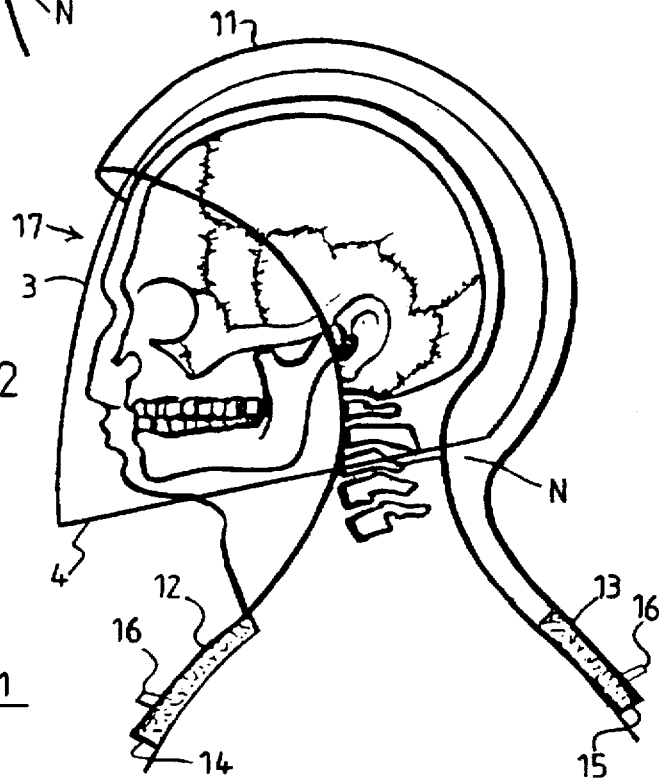
FIG. 2 is a pictorial side view corresponding to FIG. 1, when a head capsule is contained by a retainer capsule.
Figure 7:
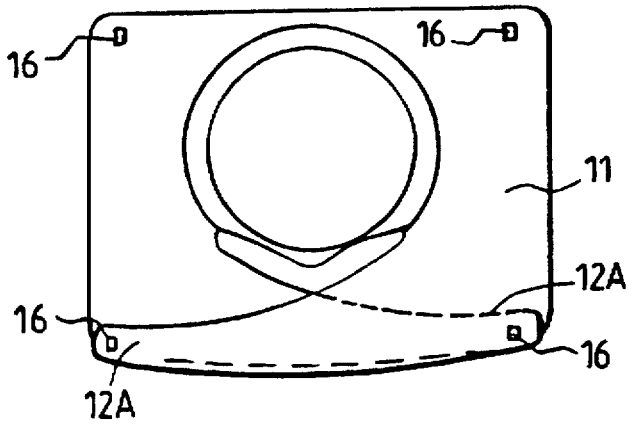

FIG. 7 is a top view corresponding to an alternative shoulder portion for the retainer capsule of FIG. 2.

Figure 8:
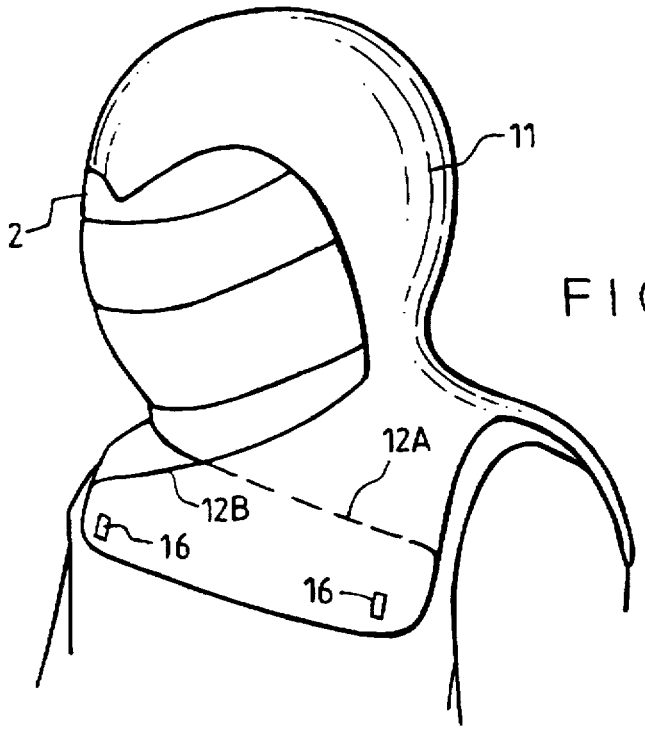

FIG. 8 is a pictorial front view corresponding to FIG. 7.

Figure 9:
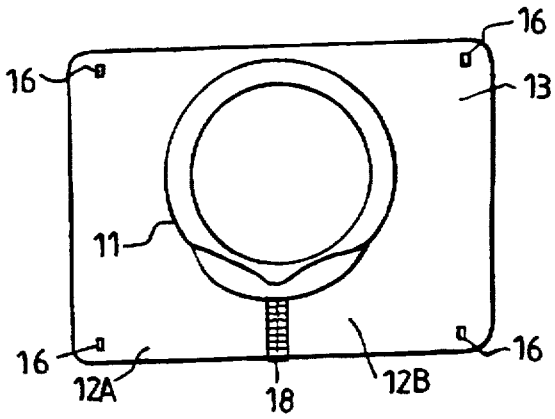

FIG. 9 is a top view of a further shoulder portion for the retainer capsule of FIG. 2.

Figure 10:
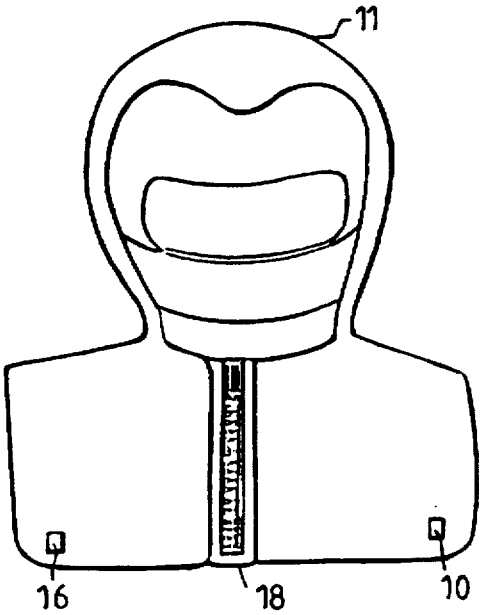

FIG. 10 is a pictorial front view corresponding to FIG. 9.

Figure 11:
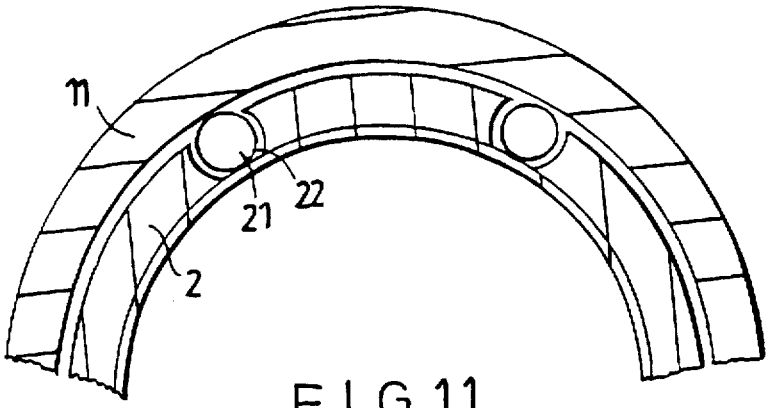

FIG. 11 is a top view showing one example of utilising ball bearings as friction reduction means.

Figure 12:
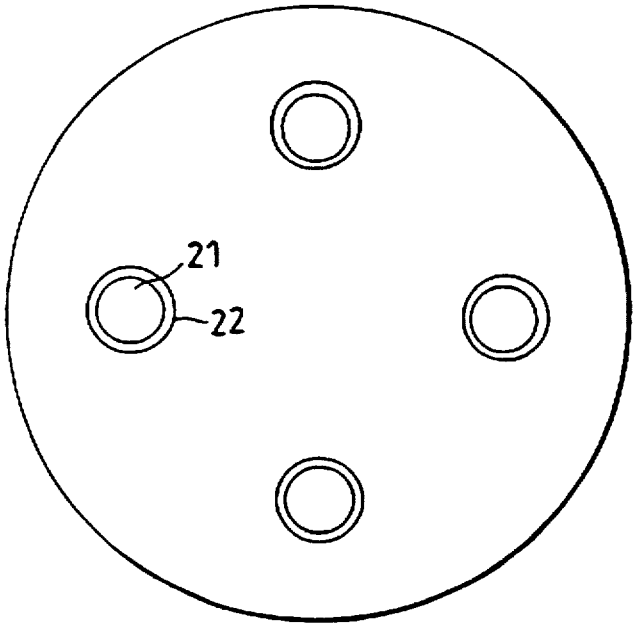

FIG. 12 is a sectional side view corresponding to FIG. 11.

Figure 13:
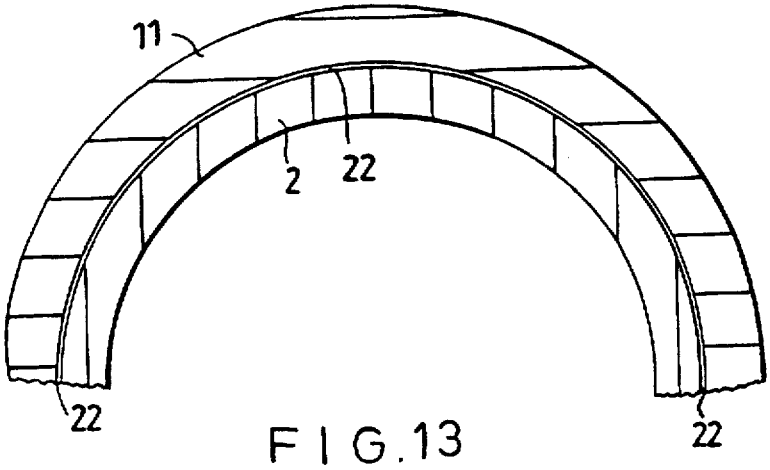

FIG. 13 is a sectional side view showing polymeric friction reduction material between a head capsule and a retainer capsule.

Figure 14:
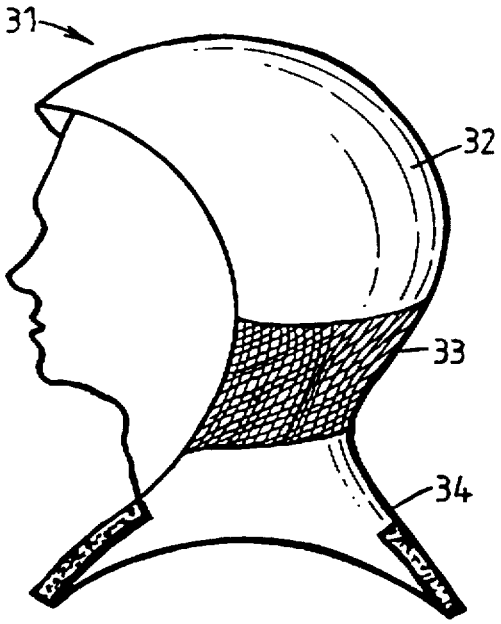

FIG. 14 is a side viewshowing one example of articulation means for a retainer capsule.

Figure 15:
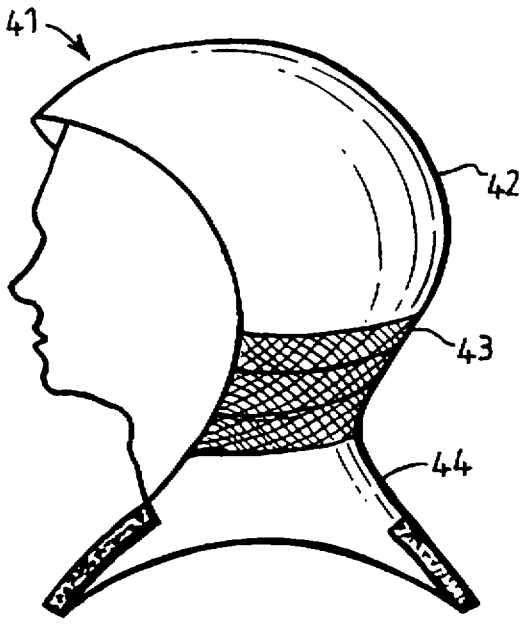

FIG. 15 is a side view showing another example of articulation means for a retainer capsule.

Figure 1:
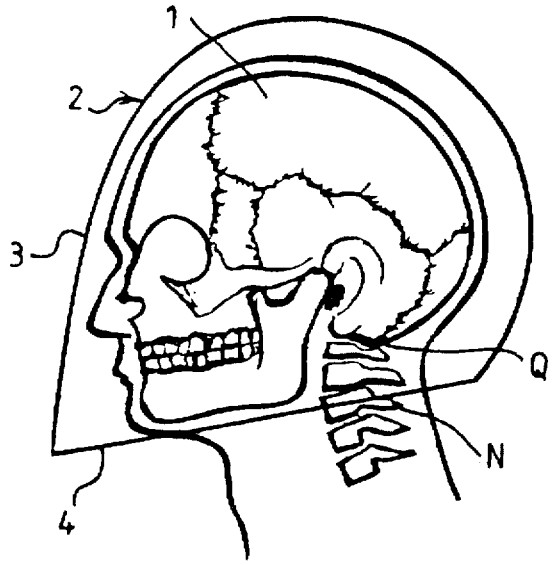
FIG. 1 is a side view of one example of a protective helmet for any suitable application, e.g. for a person seated on a motor cycle or in a motor car or racing car.
Figure 16:
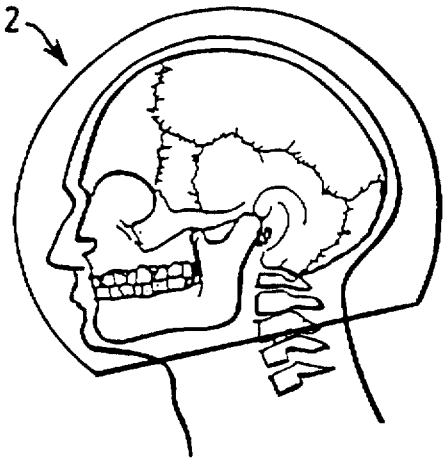
Figure 17:
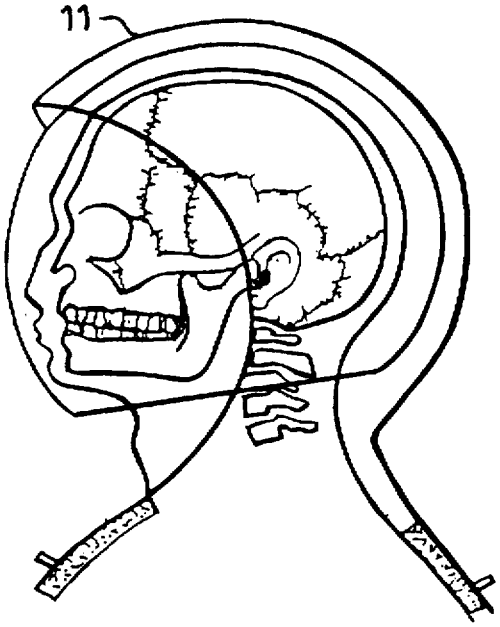

FIGS. 16,17 respectively show modifications of FIGS. 1,2 in which identical references are given.

Given the schematic nature of the drawings, it should be noted that they do not show actual embodiments of clothing (e.g. a balaclava, a boiler suit, or an overall, etc. for any suitable application) that may be worn by a person.

Figure 3:
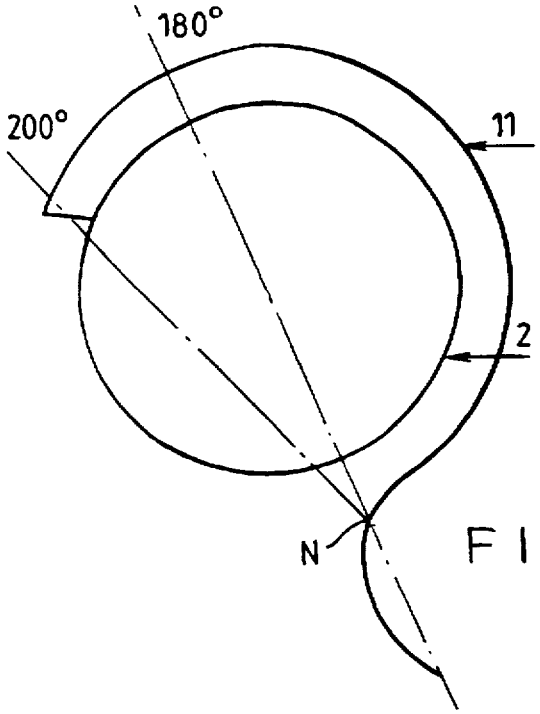
FIG. 3 shows the nature of the ball and socket joint constituted by the head capsule and retainer capsule of FIG. 2.

FIG. 1, shows a person's cranium 1 covered by head capsule 2 (which is one example of the second head covering) through which a person may view out of the helmet. For this purpose, at least a portion (e.g. a window portion) of the head capsule may be sufficiently transparent, e.g. have a transparent front 3 serving as an integral visor or vizard (see FIG. 6). optionally, a visor or vizard may itself be movable, e.g. upwardly and/or downwardly pivotably comprised by a retainer capsule 11, (which is one example of the first head covering) e.g. as shown at 3A in FIG. 6. An alternative to a window portion is an aperture. The head capsule protects the face, chin, jaw, and top of a person's cranium. The bottom edge 4 of the head capsule extends around the neck region below the person's chin, and corresponds to passing through the uppermost third cervical vertebra N (FIGS. 1, 2, 3). The atlanto-occiptial junction is shown at Q (FIG. 1). The head capsule may be inserted into the retainer capsule 11 (FIG. 2), by the person or during manufacture. The person's head will be inserted in the head capsule before or after the head capsule is present in the retainer capsule.

FIGS. 2 and 5 show the retainer capsule 11 has: two front shoulder portions 12 passing over the front shoulder portions of the person; and one rear shoulder portion 13 passing over the rear shoulder portions of the person. The shoulder portions 12, 13 are similar, and have left and right shoulder paddings 14, 15 respectively. The shoulder portions 12, 13 have quick release button fasteners 16, (FIGS. 4,5), two at the front corresponding to the left and right shoulders, and two at the rear corresponding to the left and right shoulders. Fasteners 16 enable the retainer capsule 11 to be fastened to the person, e.g. to the person's outer clothing, for instance to a jacket or suit. The person's head is free to move inside the retainer capsule, because (see FIG. 3) the head capsule is a ball member within the socket member constituted by the retainer capsule. The retainer capsule 11 has a front opening 17 (FIG. 2), for protrusion of the front 3 of the head capsule 2.

FIG. 3 shows the ball and socket joint constituted by the head capsule 2 and retainer capsule 11 of FIG. 2. The retainer capsule has a convex arcuate extent in the preferred range substantially 180° to at least substantially 200°, measured from start of the convexity, which commences at any suitable cervical vertebra at the upper region of the cervical spine e.g. at the uppermost third, fourth, or fifth cervical vertebra. The minimum angle of substantially 180° is a practical lower value compatible with use. The upper angle of substantially 200° is also a practical upper value compatible with use. In general, the lower and upper angles may have any suitable values.

Figure 4:
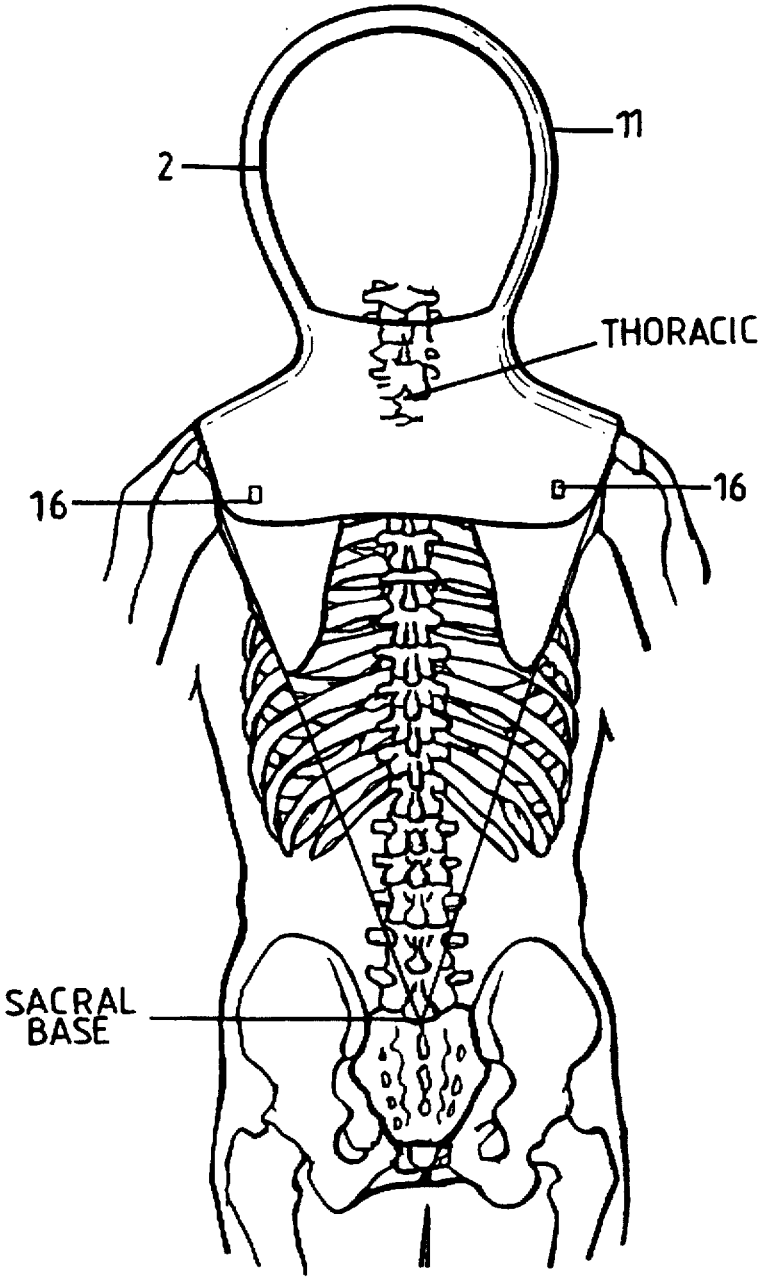
FIG. 4 is a pictorial rear sectional view corresponding to FIG. 2.

FIG. 4 shows the button fasteners 16 of FIG. 2 may be located relative to the sacral base SB of the person's spine, preferably symmetrically located. The rear of the retainer capsule 11 is shown sectioned by detail broken away (for ease of description), to allow the rear to be seen of the head capsule 2.

FIG. 5 shows an example of the retainer capsule 11, whose front shoulder portion, 12 one comprises a left front flap 12A and a right shoulder flap 12B. The rear shoulder portion 13 extends across the rear of the left and right shoulders. The top of the head capsule 2 (i.e. the second head covering) is shown in FIG. 5, indicating the head capsule 2 may comprise, as part of its construction, an optional T-junction suture 31, which allows the head capsule 2 to contract or expand according to whether or not a person's head is within the head capsule. This contraction preferably aids insertion of the head capsule into the the retainer capsule. The T-junction 31 may be provided in any suitable manner, e.g. by the head capsule being a composite structure comprising head capsule portions 32, 33, 34 interconnected in any suitable expandable/contractable manners, for instance by means of optional suture(s) constituted by e.g. elastomeric T-junction suture 31 integral with or bonded or otherwise fastened to head capsule portions 32, 33, 34. Any such fastening(s) may be provided in any suitable manner (s), e.g. comprise adhesive bonding(s) and/or fastener(s). The head capsule may be a structure such that T-junction suture 31 may be secured to or integral with at least one portion of the head capsule.

FIG. 6 is a pictorial view corresponding to FIG. 4, showing the flaps 12A, 12B downwardly located but not crossing over in their fastening to the person. For ease of illustration, the person's face is not shown.

FIG. 7 shows a further example of the retainer capsule 11, whose left front flap 12A and right front flap 12B cross over in their fastening to the person.

FIG. 8 is a pictorial view corresponding to FIG. 7, showing the front flaps 12A, 12B crossed over in their fastening to the person. For ease of illustration, the person's face is not shown.

FIG. 9 shows another example of the retainer capsule 11, whose left front flap 12A and a right front flap 12B, are joined together by a quick release zip fastener 18. The rear shoulder portion 13 of the retainer capsule extends across the rear of the left and right shoulders.

FIG. 10 is a pictorial view corresponding to FIG. 9.

FIG. 11 shows spherical ball bearings 21 retained in respective compartments 22 within the upper surface of a head capsule 2. The ball bearings are able to roll in omnidirectional manner on the inner surface of a retainer capsule 11 (e.g. FIGS. 2, 5). FIG. 12 is an elevational section corresponding to FIG. 11.

FIG. 13 shows a head capsule 2 and a retainer capsule 11 (e.g. FIGS. 2, 5) with polytetrafluoroethylene (PTFE) friction reduction material 22 between those capsules. The PTFE material 22 may be liquid and/or solid on the upper surface of the head capsule, and/or be liquid and/or solid on the inner surface of the retainer capsule, or be an insert between those capsules. The PTFE material 22 may be replaced by e.g. silicone friction reduction material, e.g. a silicone liquid and/or silicone solid, for instance silicone grease and/or silicone oil.

FIG. 14 shows one example of an alternative retainer capsule 31 corresponding to the retainer capsule 11 of FIG. 2. The alternative capsule 31 comprises a skull portion 32, articulation means 33, and neck portion 34, the articulation means 33 being between and connected to all of the skull portion 32 and neck portion 34 in any suitable manner(s), e.g. by adhesive, inlaying, rivoting, and/or sewing. The articulation means 33 is a neck covering that replicates the muscular system of the neck in various motion(s), e.g. bending, compressing, extending, flexing, rotating, and/or translating (e.g. side-to-side) motions. The articulation means 33 may be shock absorbing. The articulation means 33 is protectively rigid, e.g. to prevent collapse of the skull portion 32 and neck portion 34. The articulation means 32 is preferably protective against penetration by impact, e.g. of stone, etc. The articulation means is made from any suitable material(s) in any suitable manners, e.g. a single segment wire mesh, etc. as described earlier above.

FIG. 15 shows another example of an alternative capsule 41 corresponding to the retainer capsule 11 of FIG. 2. The capsule 41 comprises an articulation means 43 corresponding to articulation means 33 of FIG. 14. Articulation means 43 is a three segment wire mesh; otherwise it is the same as articulation means 33. In general, there may be two or more such segments.

It will be appreciated that the articulation means 33 or 43 enables freedom of movement of the skull portion 32 relative to the shoulder portions 12, 13 of the retainer capsule 31 or 41.

The present invention as exemplified in the drawings may be embodied in any suitable manners as disclosed above before the first reference to the drawings. The invention includes equivalents and/or modifications within the scope of all of the above disclosures and/or within the scope of the accompanying drawings, e.g. FIGS. 16,17 respectively show modifications of FIGS. 1,2 by the identical references 2 and 11.

I claim:

1. Protective headwear, comprising:

a first head covering for covering at least one portion of a person's head;

a second head covering for covering at least one portion of the person's head, at least one portion of said second head covering being within, or adapted to be at least partly within said first head covering, such that said first and second head coverings are in joint relationship whereby said second head covering is movable relative to said first head covering;

said first covering comprising at least one articulation means for enabling articulation of said first head covering; such that at least one portion of said first head covering is articulatable relative to at least one further portion of said first head covering; and said at least one articulation means being contractible and comprising further an element selected from the group consisting of at least one cloth, at least one bellows, at least one elastometer and at least one mesh.

2. Protective headwear as claimed in claim 1, wherein at least one said articulation means comprises at least one cloth.

3. Protective headwear as claimed in claim 1, wherein at least one said first articulation means comprises at least one bellows.

4. Protective headwear as claimed in claim 1, wherein at least one said first articulation means comprises at least one elastomer.

5. Protective headwear as claimed in claim 1, wherein at least one said first articulation means comprises at least one wire.

6. Protective headwear, comprising:

a first head covering for covering at least one portion of a person's head;

a second head covering for covering at least one portion of the person's head, at least one portion of said second head covering being within, or adapted to be at least partly within said first head covering, such that said first and second head covering are in joint relationship whereby said second head covering is movable relative to said first head covering;

said first covering comprising at least one articulation means for enabling articulation of said first head covering; such that at least one portion of said first head covering is articulatable relative to at least one further portion of said first head covering; and said at least one articulation means being expandable and comprising further an element selected from the group consisting of at least one cloth, at least one bellows, at least one elastometer, and at least one mesh.

7. Protective headwear, comprising:

a first head covering for covering at least one portion of a person's head, at least one portion of the person's neck, at least one portion of the person's cervical spine, at least one portion of the person's shoulders, at least one portion of the person's chest, and at least one portion of the person's back, said first head covering being protectively rigid, said first head covering being adapted to allow the person to view through said first head covering;

a second head covering for covering at least one portion of the person's head, at least one portion of said second head covering being at least partly within said first head covering, such that said first and second head coverings are in a ball and socket relationship wherein said first head covering is a socket portion and said second head covering is a ball portion, whereby said second head covering is movable relative to said first head covering; and at least one articulation means comprised by at least one portion of said first head covering, said at least one articulation means being flexible, resilient, contractible, and expandable, so as to conform to various motions of the person's neck and comprising further an element selected from the group consisting of at least one cloth, at least one bellows, at least one elastomer, and at least one mesh.

8. Protective headwear as claimed in claim 7, wherein at least one said articulation means comprises at least one cloth.

9. Protective headwear as claimed in claim 7, wherein at least one said articulation means comprises at least one bellows.

10. Protective headwear as claimed in claim 7, wherein at least one said articulation means comprises at least one elastomer.

11. Protective headwear as claimed in claim 7, wherein at least one said articulation means comprises at least one wire.

* * * * *